US006702389B2

(12) United States Patent
Hall, Jr. et al.

(10) Patent No.: US 6,702,389 B2
(45) Date of Patent: Mar. 9, 2004

(54) SELF STRETCHING LOW-BACK OCCUPANT SUPPORT

(75) Inventors: William Fred Hall, Jr., LaGrange, GA (US); Bernhard Zeiler, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/197,126

(22) Filed: Jul. 17, 2002

(65) Prior Publication Data

US 2004/0012240 A1 Jan. 22, 2004

(51) Int. Cl.[7] ..... A47C 7/02

(52) U.S. Cl. ..... 297/452.56; 297/440.11; 297/440.14; 297/440.15; 297/440.1

(58) Field of Search ..... 297/452.56, 440.11, 297/440.14, 440.15, 440.1

(56) References Cited

U.S. PATENT DOCUMENTS

| | | | | |
|---|---|---|---|---|
| 2,085,475 A | * | 6/1937 | Saives | 297/452.56 |
| 3,086,225 A | * | 4/1963 | Fillingim | 297/452.56 X |
| 2002/0033630 A1 | * | 3/2002 | Takata | 297/452.56 |

* cited by examiner

*Primary Examiner*—Peter R. Brown
*Assistant Examiner*—Rodney B. White
(74) *Attorney, Agent, or Firm*—Terry T. Moyer; Jeffery E. Bacon

(57) ABSTRACT

A seat structure having an elastomeric fabric connected to spaced apart support members which are pivotally secured to a support plate to allow one or both of said spaced apart support members to be pivoted away from the other to provide a desired tension in the elastomeric fabric.

17 Claims, 6 Drawing Sheets

SELF STRETCHING LOW-BACK OCCUPANT SUPPORT

BACKGROUND

This invention relates to an inexpensive and readily replaceable seat and/or seat fabric for use in trucks, tractors, cars, furniture, etc. that can be installed and/or replaced in situ without complicated procedures and/or hand tools.

Prior to this invention seats and seat elements using elastomeric fabrics for comfort and adjustability had to be prestretched during manufacture or upon installation in the desired environment such as in a chair and/or a vehicle using special stretching machine or tools. Such stretching of the elastomeric fabric was complicated, time consuming and expensive that required skilled operators and special tools.

It is, therefore, an object of the invention to provide a seat using an elastomeric fabric for support which can be readily instaled and/or replaced using simple tools such as allen wrenches, etc. to provide the required rigidity, positioning and/or comfort for the user of the seat.

BRIEF DESCRIPTION OF THE DRAWINGS

Other objects and advantages of the invention will become readily apparent as the specification proceedes to describe the invention with reference to the accompanying drawings in which.

DETAILED DESCRIPTION

Figure 1:
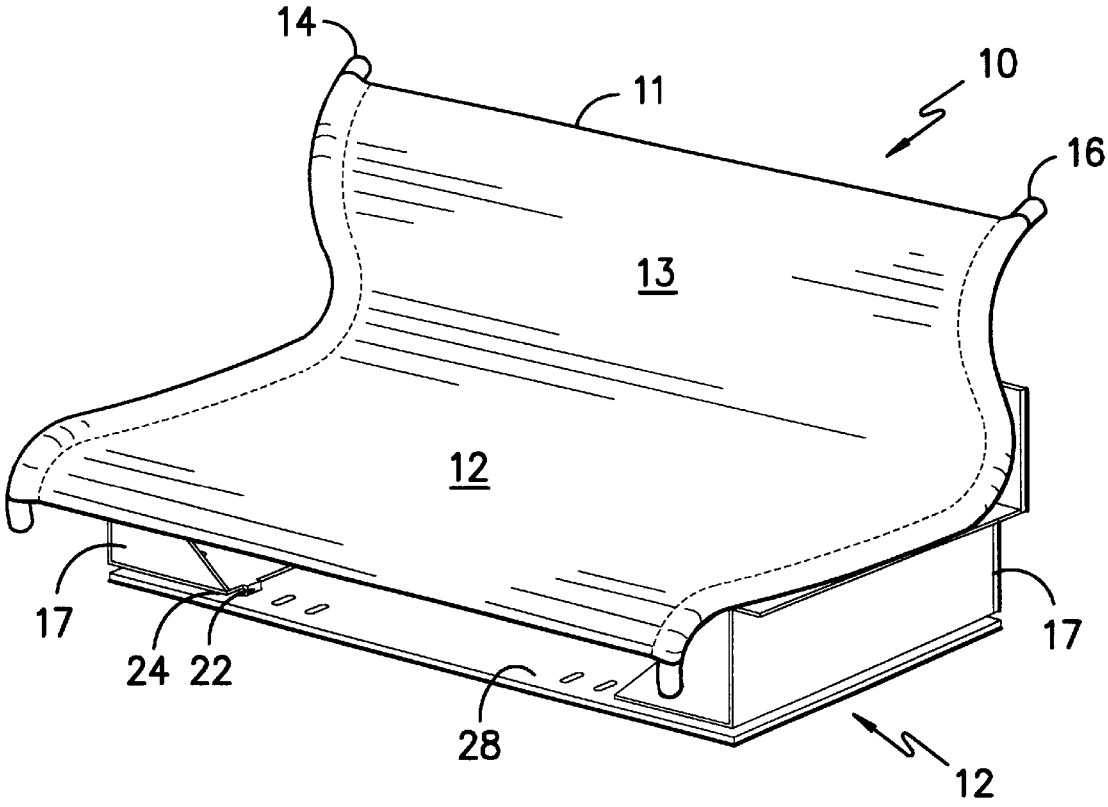
FIG. 1 is a schematic representation of a seat using an elastomeric fabric for body support.
Figure 2:
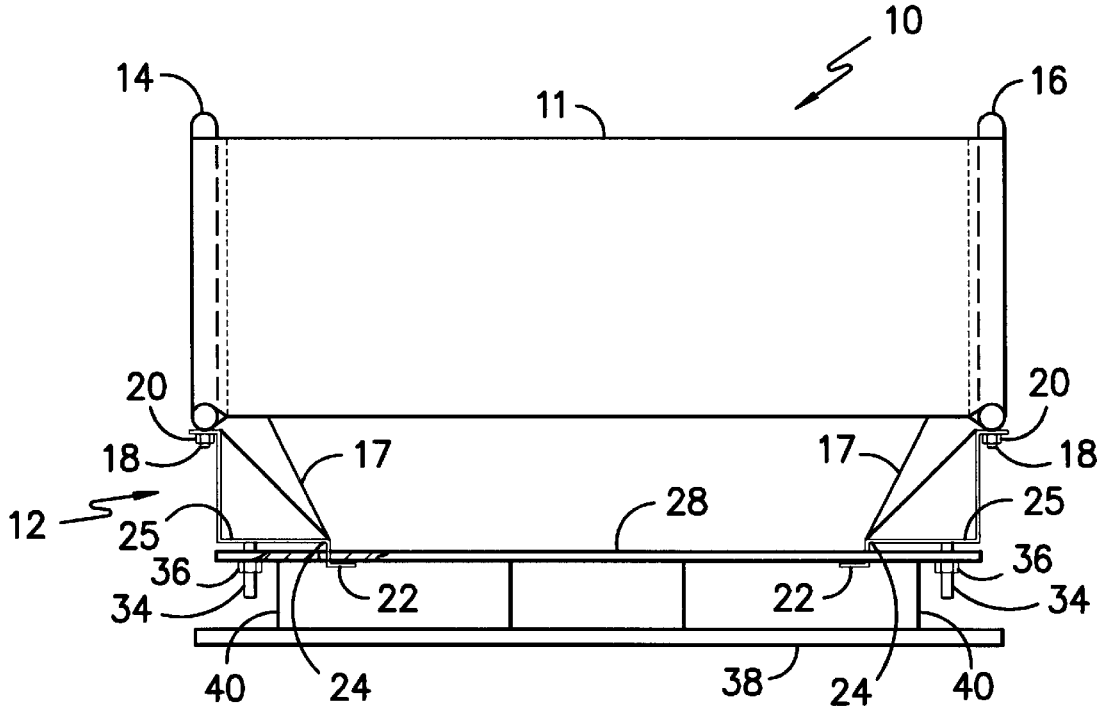
FIG. 2 is a partial sectional view looking at the front of the seat shown in FIG. 1.
Figure 3:
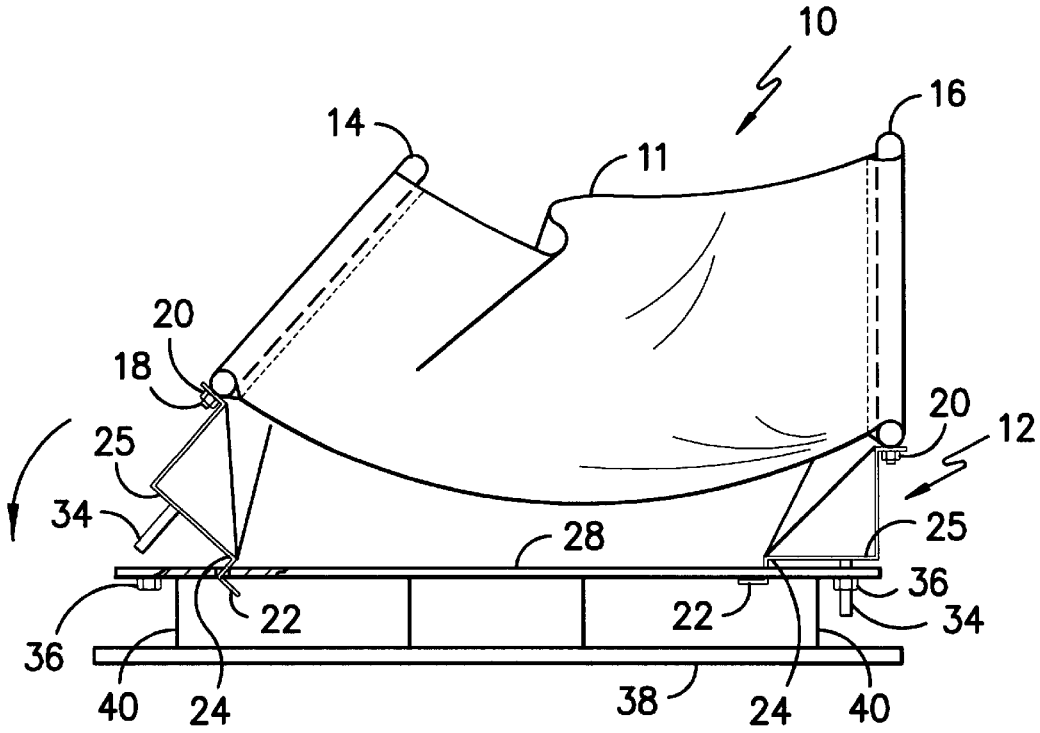
FIG. 3 is a view illustrating the installation and stretching of the elastomeric body support fabric.
Figure 4:
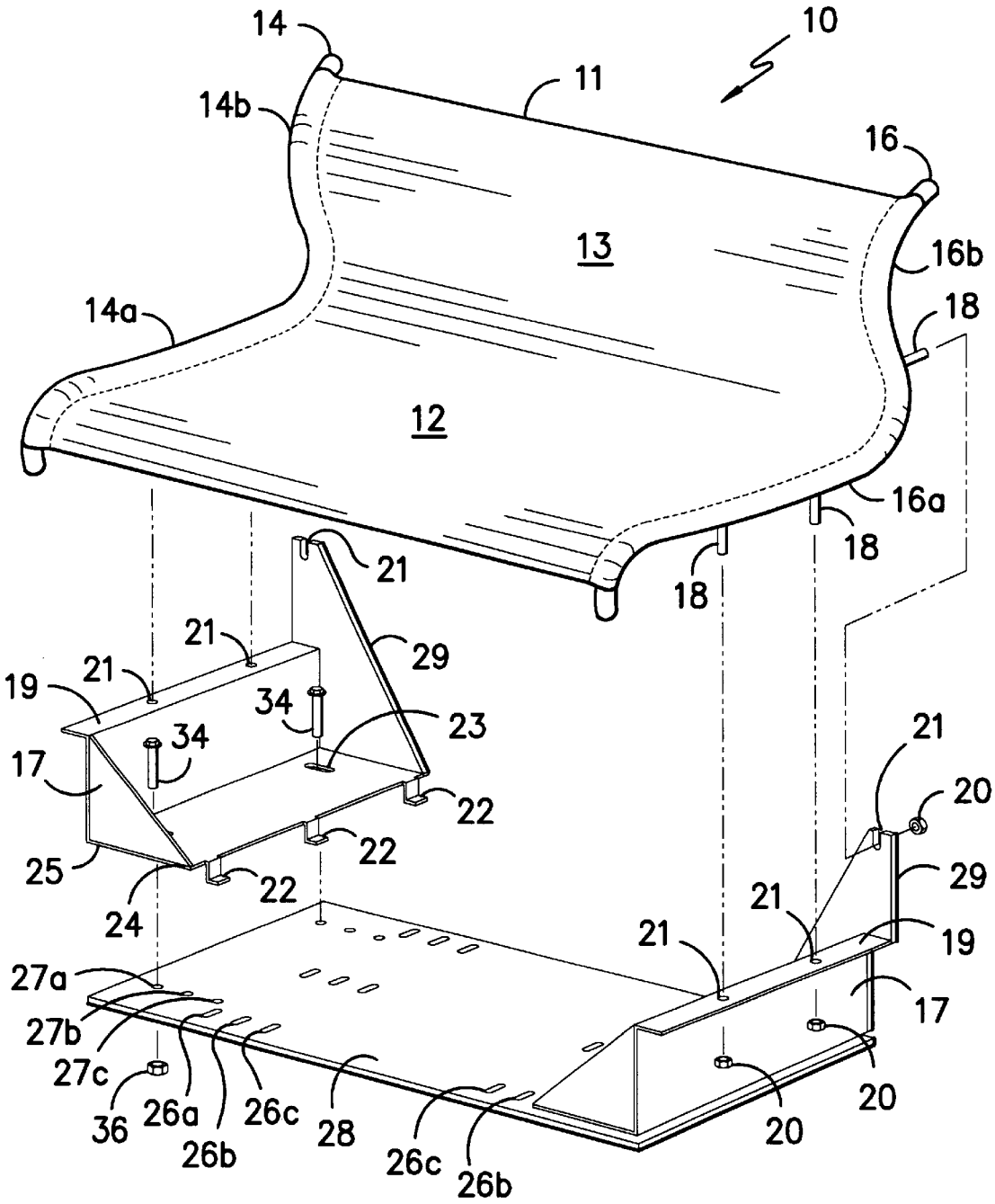
FIG. 4 is an exploded view of the seat of FIGS. 1–3 showing the interconnection of the elements thereof.

Referring now to FIGS. 1–4, the preferred occupant support 10 of the invention generally comprises a supporting structure 12 to which the frame members 14 and 16 are connected thereto, and a web 11 mounted between the frame members 14 and 16 to support the body of an individual occupant thereon.

The web 11 can be a textile, such as a woven, unit, and/or non-woven material. The web 11 is preferably an elastomeric fabric, and can be a fancy or leno woven 100% polyester fabric. It is understood that such a fabric is only preferred and other elastic fabrics, knitted or nonwoven, could be employed, if desired. It is also contemplated that the web 11 could be a plastic-like film so long as it has the characteristics of the desired elasticity and recovery. One preferred fabric is a 100% polyester leno weave fabric with a 1000 denier monofilament warp yarn with 42 ends/inch and a combined fill yarn of 35.6 picks/inch of a 3/150/34 yarn and a 8.40 picks/inch 400 denier yarn. All of the yarns are polyester with the stet having a greige weight of 13.95 ounces/yard and a finished pick and end count of 42.

The web 11 can be molded or otherwise secured to the frame member 14 and 16. In one embodiment of the invention, the frame members 14 and 16 have a lower support section 14*a* and 16*a*, and a corresponding upper or back support section 14*b* and 16*b*. In this manner, the frame members 14 and 16 can form a lower support area 12 and a back suport area 13 of the web 11. The frame members 14 and 16 also have threaded members 18 for securing to the supporting structure 12.

The supporting structure 12 generally comprises two supporting members 17 and a support plate 28. The support members 17 have frame attachment apertures 21 on a flange or upper portion 19 for receipt of the threaded attachment members 18 from the frame members 14 and 16. Nuts 20 secure the threaded members 18 from the frame members 14 and 16 to their corresponding support members 17. In one embodiment, the support members 14 and 16 include upright support sections 29 securing the corresponding upper support sections 14*b* and 16*b* to the associated support members 17.

As illustrated in FIGS. 1–5, the support members 17 also have a plurality of tabs 22 extending from an inner bottom edge 24 of the support members 17. Support member securing apertures 23 are located on a lower aft portion 25 of the support members 17.

The support plate 28 has opposing sets of tab apertures 26*a*, 26*b*, 26*c*, and corresponding sets of support securing apertures 27*a*, 27*b*, 27*c*. Each set of tab apertures 26*a*, 26*b*, 26*c*, are postioned for receipt of the tabs 22 from the support members 17 in various positions on the support base 28. The corresponding support apertures 27*a*, 27*b*, 27*c*, are positioned for aligning with the corresponding securing apertures 23 in the support members 17. In this manner, the tabs 22 of the support members 17 can engage the selected set of tab apertures 26*a*, 26*b*, and 26*c*, of the support plate 28 in a pivotal manner. Once the tabs 22 have pivotatilty engaged the support plate 26, the support members 17 can be pivoted until the support member securing apertures 23 align with the appropriate set of support base apertures 27*a*, 27*b*, or 27*c*, and the support member 17 can be secured to the support base 28 by bolts 34 and nuts 36, or other similar means, through the support member securing apertures 23 and the support base apertures 27*a*, 27*b*, or 27*c*.

In the present inevention, it is comtemplated that the web 11 secured to the frame members 14 and 16 will be secured to the support members 17 prior to the support members 17 being secured to the support base 28. In this manner, the outward pivotal action of one or both of the support members 17, due to the tabs 22 engaging the tab apertures 26*a–c* in the support base 28, will create tensioning of the web 11 to reduce any slack and apply tension in the web 11. By selecting the appropriate set of tab apertures 26*a–c*, the appropriate amount of tension can be applied to the web 11 for the appropriate width of the web 11. The seat 10 can then be secured to a base plate 38 by suitable means 40 for attachment to the desired end product, such as a vehicle or furniture or can be attached directly to the desired end product by any suitable means, not shown.

Figure 5:
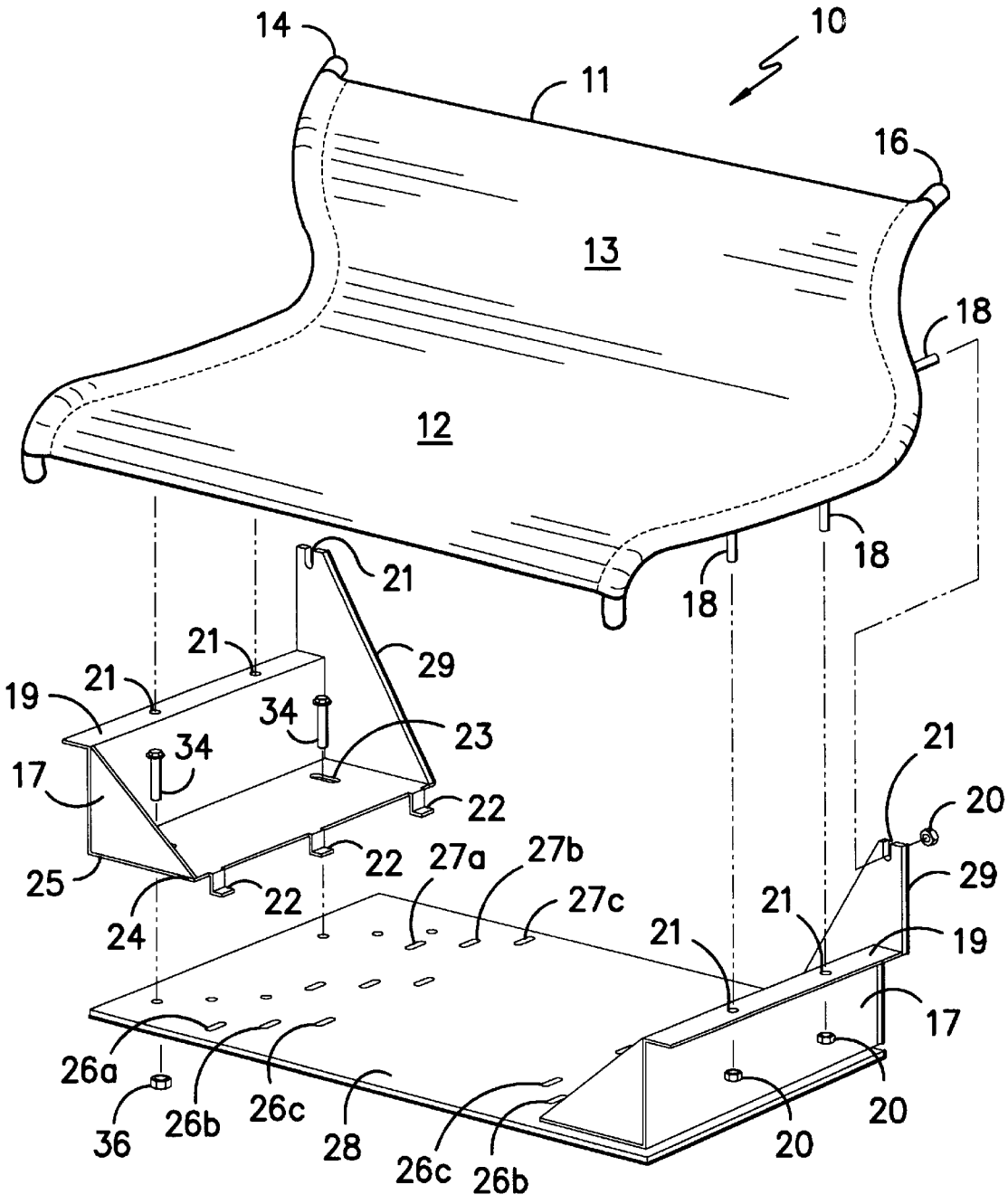
FIG. 5 is a view similar to FIG. 4 showing an alternative interconnection arrangement.

FIG. 5 is a variation of the form of the invention shown in that each set of the tab apertures 26*a–c* is off-set from the adjacent set of tab apertures 26*a–c* to provide for selective front and back positioning of the web 11 on the support base 28. This allows the manufacturer, distributor and/or the user of the seat 10 to provide for selective front or back positioning of the supporting elastomeric fabric 11.

Figure 6:
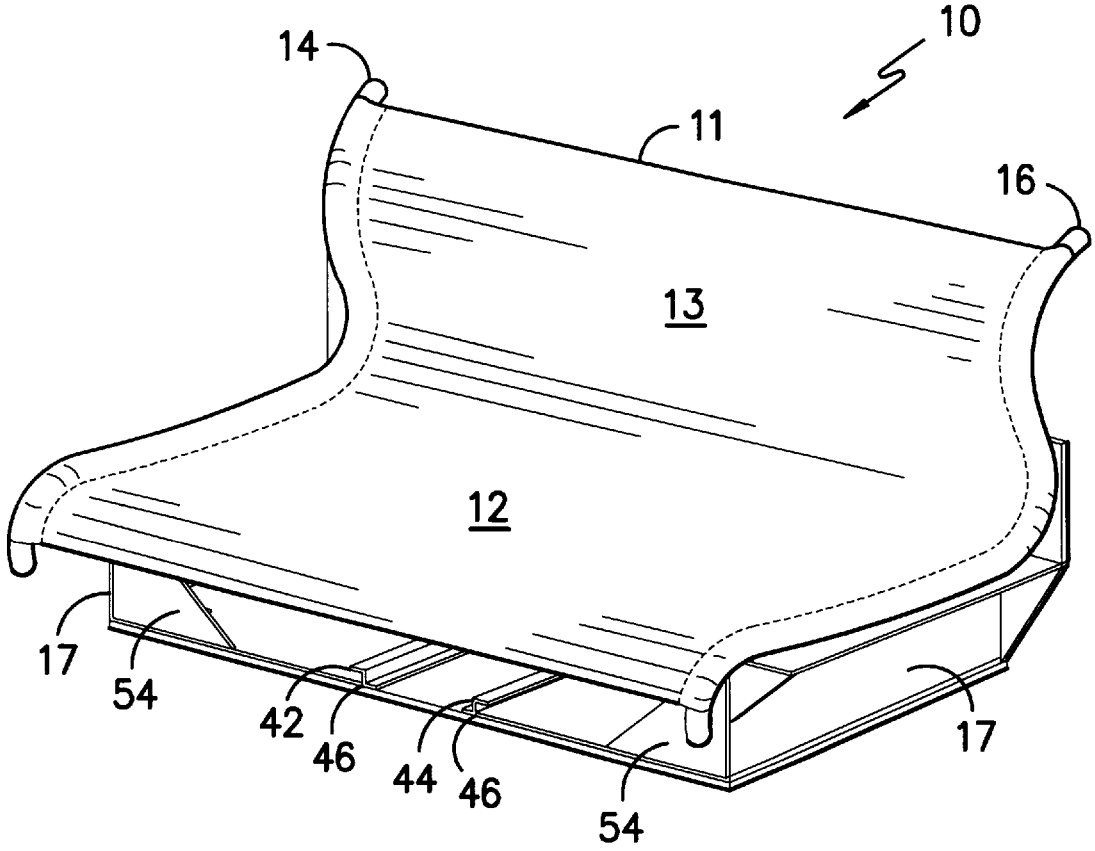
FIG. 6 illustrates an alternative seat arrangement.
Figure 7:
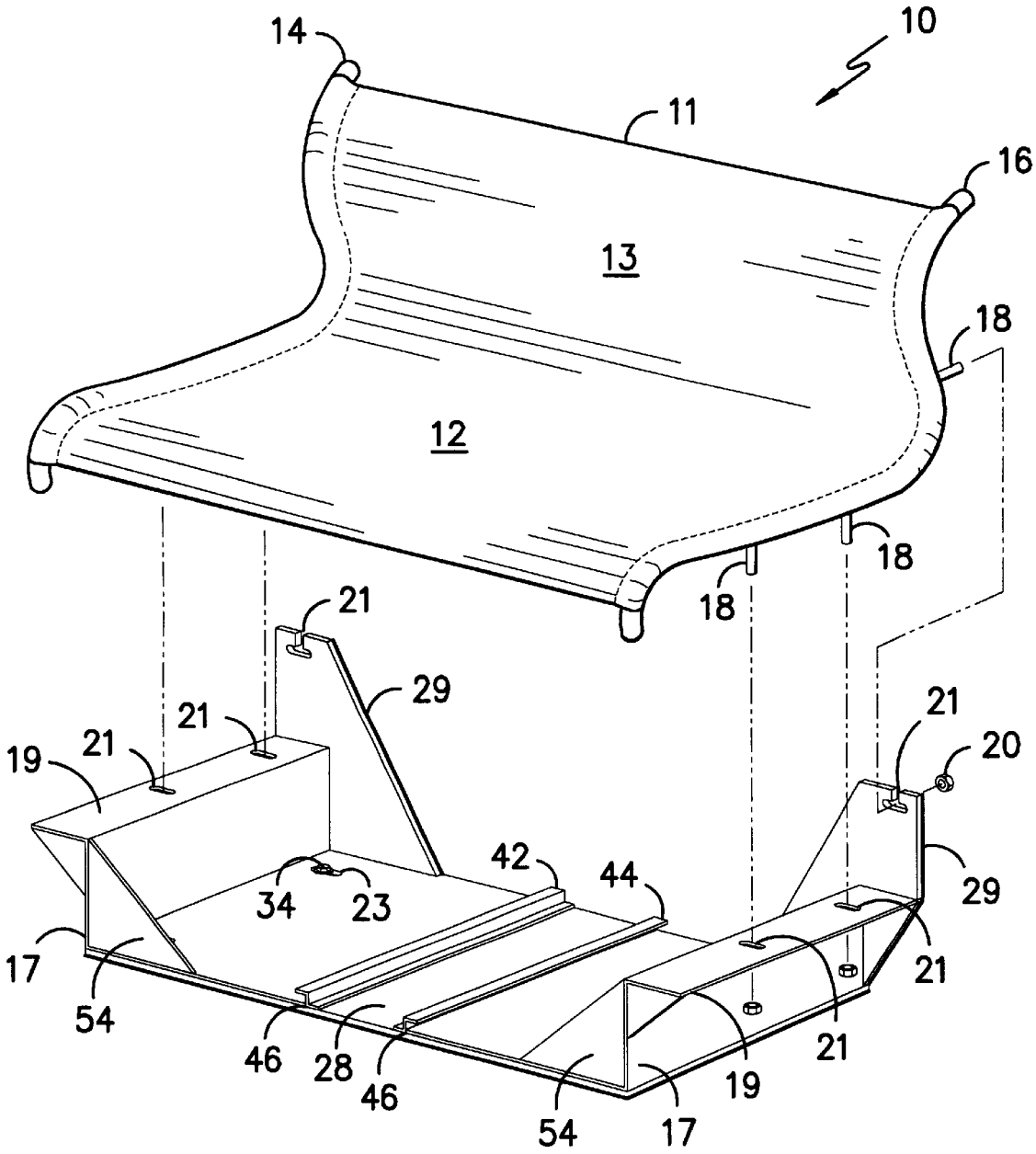
FIG. 7 is a view similar to FIG. 4 showing the exploded interconnections for the seat of FIG. 6.

Looking now to FIGS. 6 and 7 there is shown a modified arrangement of attaching the supporting structure 12 to the support base 28. Rather than using the tab apertures 26*a–c* and the cooperating tabs 22, a pair of Z-shaped bars 42 and 44 are welded or otherwise secured to the support plate 28 centrally thereof to provide a stop for a leading edge 46 of the support members 17. The Z-shaped bars 42 and 44 also form a channel for the receipt of the leading edge 46. To provide for lateral movement of the support members 17, elliptical slots or apertures 23 are provided in the base thereof to accommodate the bolts 34 and nuts 36. Also, the frame attachement apertures 21 in the upper flange portion 19 of the support member 17 are also elliptical shaped to provide for lateral adjustment of the frame members 14 and 16 thereto. As with the basic embodiment of FIGS. 1–4, shown specifically in FIG. 3, one or both of the support members 17 can be pivoted outward to provide the desired tension in the elastomeric fabric 11 prior to securing in place by tightening the bolts 34. A further advantage of this embodiment is that the triangular side portions 54 of the triangular member 17 can be lengthened to provide extra rigidity to the assembled seat 10.

As described heretofore a seat using an elastomeric fabric as the body support member is pre-stretched with specially designed machines at the factory either in the initial production of or to repair same after use, if necessary. These factory application methods preclude field replacement of an elastomeric fabric member which obviously can be accomplished by the herein described invention. Furthermore the herein described support design provides a simple construction which is easy and inexpensive to produce and/or repair using simple tools and little expertise. The occupant support 10 of the present invention can be used as a seat, bed, or other similar support system.

While our invention has been shown and described with reference to particular embodiments thereof, those skilled in the art will understand that other variations in form and detail may be made without departing from the scope and spirit of our invention. For example, only one of the support members may have the pivotal engagement with the support base, and tensioning of the fabric is accomplished by the rotation of that single support member. Also, the pivotal engagement can be accomplished by hinges, pins, or the like.

What is claimed is:

1. An occupant support structure comprising:

a support base;

a pair of support members, each support member having an upper portion, a lower portion pivotally engaging the support base, and a securing section secured to the support base;

a web connected to the upper portion of the support members and extending therebetween for support of the occupant; and wherein the support base includes tab apertures, the support members include tabs, and the pivotal engagement of the support members with the support base is accomplished by the engagement of the tabs from the support members with the tab apertures of the support base.

2. The occupant support structure according to claim 1, wherein the support base includes multiple sets of tab apertures for acceptance of the tabs at different positions on the support base.

3. The occupant support structure according to claim 2, wherein the sets of apertures are located for the positioning of the support members closer together or further apart.

4. The occupant support structure according to claim 2, wherein the sets of apertures are located for the positioning of the support members transversely to the direction between the two support members.

5. An occupant support structure comprising:

a support base;

a pair of support members, each support member having an upper portion, a lower portion pivotally engaging the support base, and a securing section secured to the support base;

a web connected to the upper portion of the support members and extending therebetween for support of the occupant; and wherein the support base includes support member channels centrally located on the support base, and the support members include leading edges, wherein the pivotal engagement of the support members with the support base is accomplished by the engagement of the leading edges of the support members with the support member channels of the support base.

6. The occupant support structure according to claim 5, wherein the securing section of the support members includes an elongated aperture, and the securing section of the support members are secured to the support base by fasteners passing through the elongated apertures and securing the support member to the support base thereto.

7. An occupant support structure comprising:

a support base;

a pair of support members, each support member having an upper portion and a securing section secured to the support base, and wherein at least one support member has a lower portion pivotally engaging the support base;

a web connected to the support to the upper portion of the support members and extending therebetween for support of the occupant; and further including a pair of frame members, wherein the fabric is attached to the frame members and the frame members are secured to corresponding support members, and wherein the frame members are secured to the support members by threaded members extending from the frame members into frame attachment apertures in the support members, and wherein the frame fastening apertures in the support members are elongated, and threaded receptors engage the threaded members to secure the frame members to the support members.

8. An occupant support structure comprising:

a support base;

a pair of support members, each support member having an upper portion and a securing section secured to the support base, and wherein at least one support member has a lower portion pivotally engaging the support base;

a web connected to the support to the upper portion of the support members and extending therebetween for support of the occupant; and further including a pair of frame members, wherein the fabric is attached to the frame members and the frame members are secured to corresponding support members, and wherein the frame members are secured to the support members by threaded members extending from the frame members into frame attachment apertures in the support members, and wherein the frame members include a lower section forming a lower support area in the fabric, and an upper section forming a back support area in the fabric.

9. The occupant support structure according to claim 8, wherein each of the support members have upright support sections securing the upper section of the associated frame member secured thereto.

10. An occupant support structure comprising:

a support base;

a pair of support members, each support member having an upper portion and a securing section secured to the support base, and wherein at least one support member has a lower portion pivotally engaging the support base;

a web connected to the support to the upper portion of the support members and extending therebetween for support of the occupant; and wherein the support base includes tab apertures, the support member pivotally engaging the support base includes tabs, and the pivotal engagement of the support member with the support base is accomplished by the engagement of the tabs from the support member with the tab apertures of the support base.

11. The occupant support structure according to claim 10, wherein the support base includes multiple sets of tab apertures for acceptance of the tabs at different positions on the support base.

12. The occupant support structure according to claim 11, wherein the sets of apertures are located for the positioning of the support members closer together or further apart.

13. The occupant support structure according to claim 12, wherein the sets of apertures are located for the positioning of the support member pivotally engaging the support base, transversely to the direction between the two support members.

14. An occupant support structure comprising:

a support base;

a pair of support members, each support member having an upper portion and a securing section secured to the support base, and wherein at least one support member has a lower portion pivotally engaging the support base;

a web connected to the support to the upper portion of the support members and extending therebetween for support of the occupant; and wherein the support base includes a support member channel centrally located on the support base, and the support member pivotally engaging the support base includes leading edges, wherein the pivotal engagement of the support member with the support base is accomplished by the engagement of the leading edge of the support member with the support member channel of the support base.

15. The occupant support structure according to claim 14, wherein the securing section of the support member engaging the support base includes an elongated aperture, and the securing section of the support member engaging the support base is secured to the support base by a fastener passing through the elongated aperture and securing the support member to the support base thereto.

16. A method to produce a comfortable seat or bed structure for use in furniture, vehicles and other similar products comprising the steps of:

connecting an fabric between a first and a second spaced apart support members;

connecting the first support member to a support base;

pivotally engaging the second support member with the support base;

rotating the second support member relative to the support base to provide tension to the fabric;

securing the second support member to the support base at a predetermined tension in the fabric; and wherein the step of pivotally engaging includes pivotally engaging by the insertion of tabs on the support member into apertures in the support base.

17. A method to produce a comfortable seat or bed structure for use in furniture, vehicles and other similar products comprising the steps of:

connecting an fabric between a first and a second spaced apart support members;

connecting the first support member to a support base;

pivotally engaging the second support member with the support base;

rotating the second support member relative to the support base to provide tension to the fabric;

securing the second support member to the support base at a predetermined tension in the fabric; and wherein the step of pivotally engaging includes pivotally engaging by the insertion of a leading edge on the support member into a channel on the support base.

* * * * *